US011060258B2

(12) United States Patent
Miyoshi

(10) Patent No.: US 11,060,258 B2
(45) Date of Patent: Jul. 13, 2021

(54) METHOD FOR INSTALLING ROTARY MACHINE, AND ROTARY MACHINE

(71) Applicant: MITSUBISHI HEAVY INDUSTRIES COMPRESSOR CORPORATION, Tokyo (JP)

(72) Inventor: Tatsuya Miyoshi, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 44 days.

(21) Appl. No.: 16/321,273

(22) PCT Filed: Dec. 7, 2016

(86) PCT No.: PCT/JP2016/086413

§ 371 (c)(1),
(2) Date: Jan. 28, 2019

(87) PCT Pub. No.: WO2018/105065

PCT Pub. Date: Jun. 14, 2018

(65) Prior Publication Data

US 2019/0161934 A1 May 30, 2019

(51) Int. Cl.
*E02D 27/44* (2006.01)
*F04B 39/14* (2006.01)
(Continued)

(52) U.S. Cl.
CPC ..... *E02D 27/44* (2013.01); *F04B 39/121* (2013.01); *F04B 39/14* (2013.01); *F04B 35/04* (2013.01); *F04C 2230/60* (2013.01)

(58) Field of Classification Search
CPC ..... H02K 15/0006; H02K 15/00; H02K 5/00; H02K 5/26; H02K 15/02; F16M 7/00;
(Continued)

(56) References Cited

U.S. PATENT DOCUMENTS 3,604,306 A * 9/1971 Denholm ..... F16M 7/00 411/535
4,592,532 A 6/1986 Stith, Jr.
6,793,458 B2 * 9/2004 Kawai ..... F01D 25/28 415/213.1

FOREIGN PATENT DOCUMENTS

JP S60-255656 A 12/1985
JP H04-155015 A 5/1992
(Continued)

OTHER PUBLICATIONS

International Search Report and Written Opinion in corresponding International Application No. PCT/JP2016/086413, dated Feb. 14, 2017 (9 pages).

*Primary Examiner* — Rick K Chang

(74) *Attorney, Agent, or Firm* — Osha Bergman Watanabe & Burton LLP

(57) ABSTRACT

A method for installing a compressor includes a preparing step of preparing a base plate that supports a support leg onto a foundation, a level adjusting member disposing step of disposing a plurality of level adjusting members having a wedge shape onto the base plate along an outline of a lower end portion of the support leg, an adjusting step of adjusting a horizontal level of a rotary machine main body by adjusting pushing amounts of the level adjusting members to the lower end portion of the support leg, and a fixing step of fixing positions of the support leg and the level adjusting members with respect to the base plate by welding the support leg to the plurality of level adjusting members.

5 Claims, 8 Drawing Sheets

(51) Int. Cl.
*F04B 39/12* (2006.01)
*F04B 35/04* (2006.01)

(58) Field of Classification Search
CPC ..... F16M 9/00; F01D 25/285; B65G 7/06; B65G 7/04; F05D 2230/72; E02D 27/44; F04B 39/14; F04B 39/121; F04B 35/04; F04C 2230/60
See application file for complete search history.

(56) References Cited

FOREIGN PATENT DOCUMENTS

| | | | |
|---|---|---|---|
| JP | H05-339951 | A | 12/1993 |
| JP | 2016-075194 | A | 5/2016 |

* cited by examiner

METHOD FOR INSTALLING ROTARY MACHINE, AND ROTARY MACHINE

TECHNICAL FIELD

The invention relates to a method for installing a rotary machine and a rotary machine.

BACKGROUND ART

For example, in a rotary machine disclosed in Patent Document 1, a rotary machine main body having a rotary shaft is supported by support legs. When installing such a rotary machine, the plurality of support legs are fixed on a base plate installed on a foundation. After then, the rotary machine is installed by installing the rotary machine main body onto the fixed support legs.

However, it is necessary to horizontally dispose the rotary shaft of the rotary machine main body in order to install such a rotary machine. For example, there is a method of adjusting the levelness of the rotary machine main body by adjusting the position or the height of the rotary machine main body with respect to upper end portions of the support legs in order to horizontally dispose the rotary shaft.

CITATION LIST

Patent Literature

[Patent Document 1] Japanese Unexamined Patent Application, First Publication No. 2016-75194

SUMMARY OF INVENTION

Technical Problem

However, in a case where the support legs are already fixed to the rotary machine main body, it is impossible to adopt the method described above. For this reason, it is necessary to ensure the levelness of the rotary machine by adjusting the positions of the support legs with respect to the base plate.

An object of the present invention is to provide a method for installing a rotary machine and a rotary machine, in which the levelness of the rotary machine can be ensured by adjusting the positions of support legs with respect to a base plate.

Solution to Problem

According to a first aspect of the present invention, there is provided a method for installing a rotary machine that includes a plurality of support legs extending in a vertical direction and a rotary machine main body fixed to upper end portions of the support legs. The method for installing a rotary machine includes a preparing step of preparing a base plate that supports the support legs onto a foundation, a level adjusting member disposing step of disposing a plurality of level adjusting members having a wedge shape onto the base plate along an outline of each of lower end portions of the support legs, a placing step of placing each of the support legs onto the plurality of level adjusting members, an adjusting step of adjusting a horizontal level of the rotary machine main body by adjusting pushing amounts of the level adjusting members to each of the lower end portions of the support legs, and a fixing step of fixing positions of each of the support legs and the level adjusting members with respect to the base plate by welding each of the support legs to the plurality of level adjusting members.

According to such a configuration, the horizontal level adjustment of the upper end portions of the support legs can be performed by adjusting the pushing amounts of the wedge-shaped level adjusting members to the lower end portions of the support legs. Therefore, the level adjustment of the rotary machine main body fixed to the support legs with respect to the base plate can be easily and reliably performed.

According to a second aspect of the present invention, in the method for installing a rotary machine of the first aspect, a liner member disposing step of disposing a flat plate-shaped liner member onto the base plate before the level adjusting member disposing step may be further included. In the level adjusting member disposing step, the plurality of level adjusting members may be disposed onto the liner member fixed to the base plate, and in the fixing step, each of the support legs and the plurality of level adjusting members may be welded to the liner member.

According to such a configuration, even in a case where an upper surface of the base plate is not smooth, the level adjusting members can be disposed on a smooth surface of the flat plate-shaped liner member. Therefore, the level adjusting members can be easily moved when adjusting the pushing amounts of the level adjusting members to lower sides of the support legs.

According to a third aspect of the present invention, in the method for installing a rotary machine of the first or second aspect, in the preparing step, the existing support legs fixed on the base plate may be removed from the base plate.

According to such a configuration, a new rotary machine main body and new support legs can be installed with the use of the base plate to which the existing support legs had been fixed after removing the existing support legs. Therefore, work efficiency improvement and cost reduction can be achieved without a need for reinstalling the base plate.

According to a fourth aspect of the present invention, there is provided a rotary machine including a base plate installed on a foundation, a plurality of wedge-shaped level adjusting members provided on the base plate, a plurality of support legs which are placed on the plurality of level adjusting members and extend toward a vertical direction, a fixing unit which is formed by each of lower end portions of the support legs and the plurality of level adjusting members being welded to each other and fixes positions of each of the support legs and the level adjusting members with respect to the base plate, and a rotary machine main body supported by the plurality of support legs.

Advantageous Effects of Invention

According to the present invention, the levelness of the rotary machine main body with respect to the base plate can be easily and reliably adjusted when installing the rotary machine.

DESCRIPTION OF EMBODIMENTS

Hereinafter, a method for installing a rotary machine and a rotary machine of the present invention will be described with reference to the drawings. In this embodiment, a case where an already installed compressor (rotary machine) is replaced with a new compressor (rotary machine) and the new compressor is installed will be described as an example of the method for installing a rotary machine.

Figure 1:
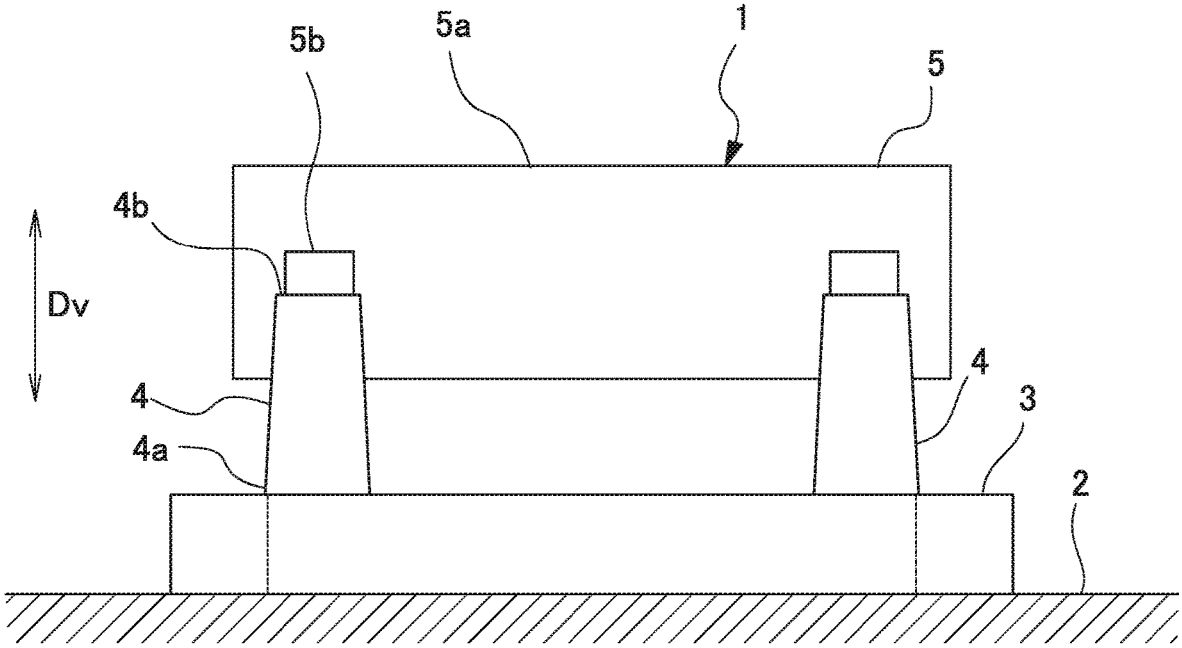
FIG. 1 is an elevation showing a schematic configuration of a first compressor before being replaced, to which a method for installing a rotary machine of the embodiment is applied.

As shown in FIG. 1, a first compressor 1, which is the already installed compressor, includes a base plate 3, a plurality of (for example, four in the embodiment) first support legs (support legs) 4, and a first compressor main body (compressor main body) 5.

The base plate 3 is provided on a foundation 2 built on the ground. The base plate 3 can support the first support legs 4. The base plate 3 forms a rectangular frame in plan view, for example, by a plurality of steel materials being combined.

The first support legs 4 are bonded and fixed onto the base plate 3. The first support legs 4 extend toward a vertical direction Dv. Lower end portions 4*a* of the first support legs 4 are directly welded onto the base plate 3. The first support legs 4 extend to an upper side in the vertical direction Dv from the lower end portions 4*a* toward upper end portions 4*b*.

The first compressor main body 5 has a casing 5*a* forming a shell thereof and supported portions 5*b* protruding outwards from an outer peripheral surface of the casing 5*a*. The first compressor main body 5 is integrally formed with the plurality of first support legs 4 by the supported portions 5*b* being bonded in a state of being placed on the upper end portions 4*b* of the first support legs 4 respectively.

Figure 2:
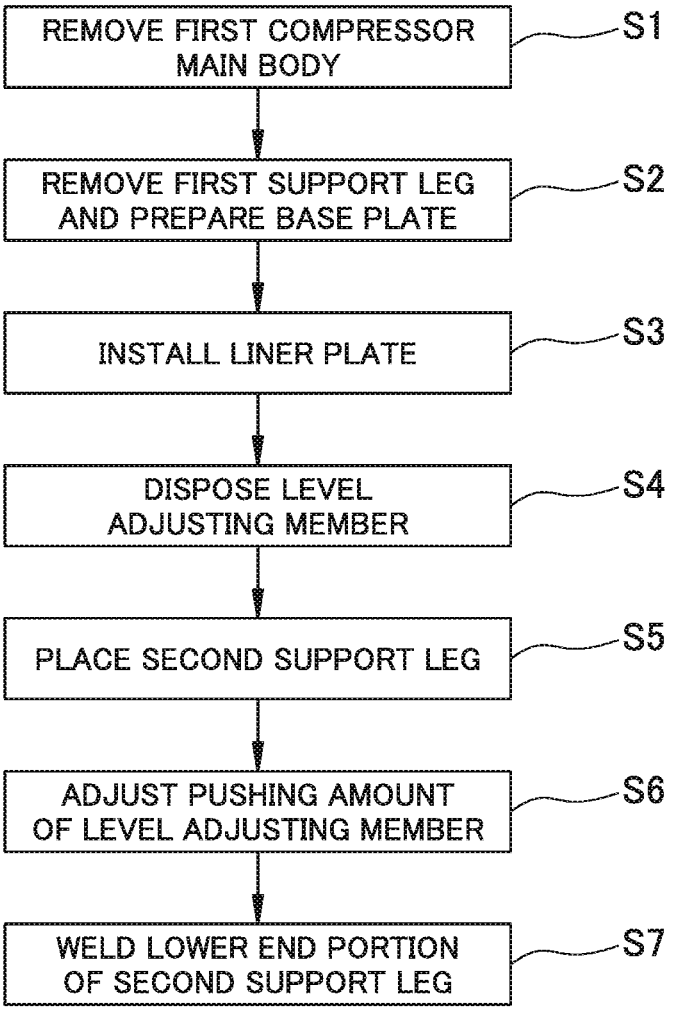
FIG. 2 is a flow chart showing flow of the method for installing a rotary machine of the embodiment.
Figure 3:
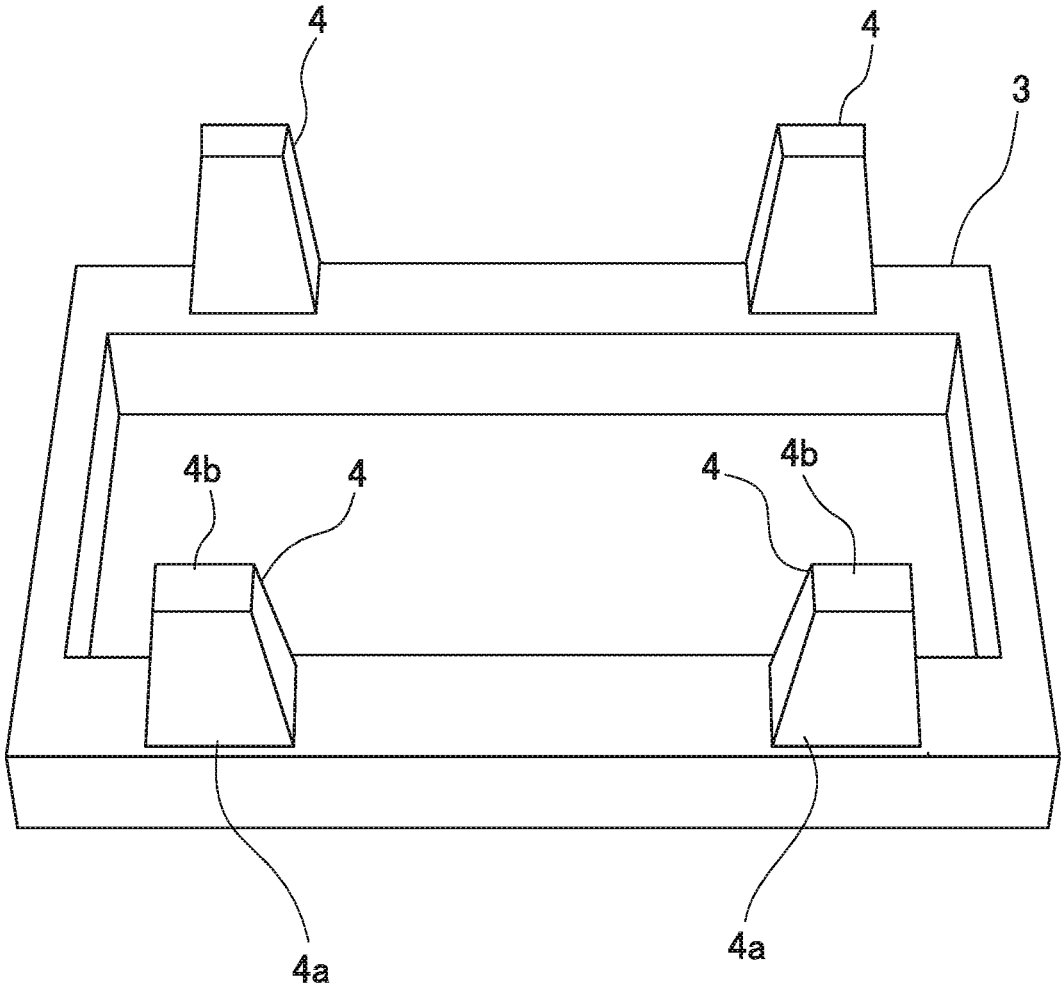
FIG. 3 is a perspective view showing a state where a first compressor main body is removed from a first support leg in the method for installing a rotary machine of the embodiment.

In order to replace the first compressor 1 described above with a second compressor 10, which is the new compressor, work is performed step by step in accordance with flow shown in FIG. 2. First, as shown in FIG. 3, the first compressor main body 5 is removed from the plurality of first support legs 4 (compressor main body removing step S1). Specifically, portions between the upper end portions 4*b* of the first support legs 4 and the supported portions 5*b* are cut by fusion cutting or the like, and thus the first support legs 4 and the first compressor main body 5 are separated from each other. After then, the first compressor main body 5 is removed from the first support legs 4.

Figure 4:
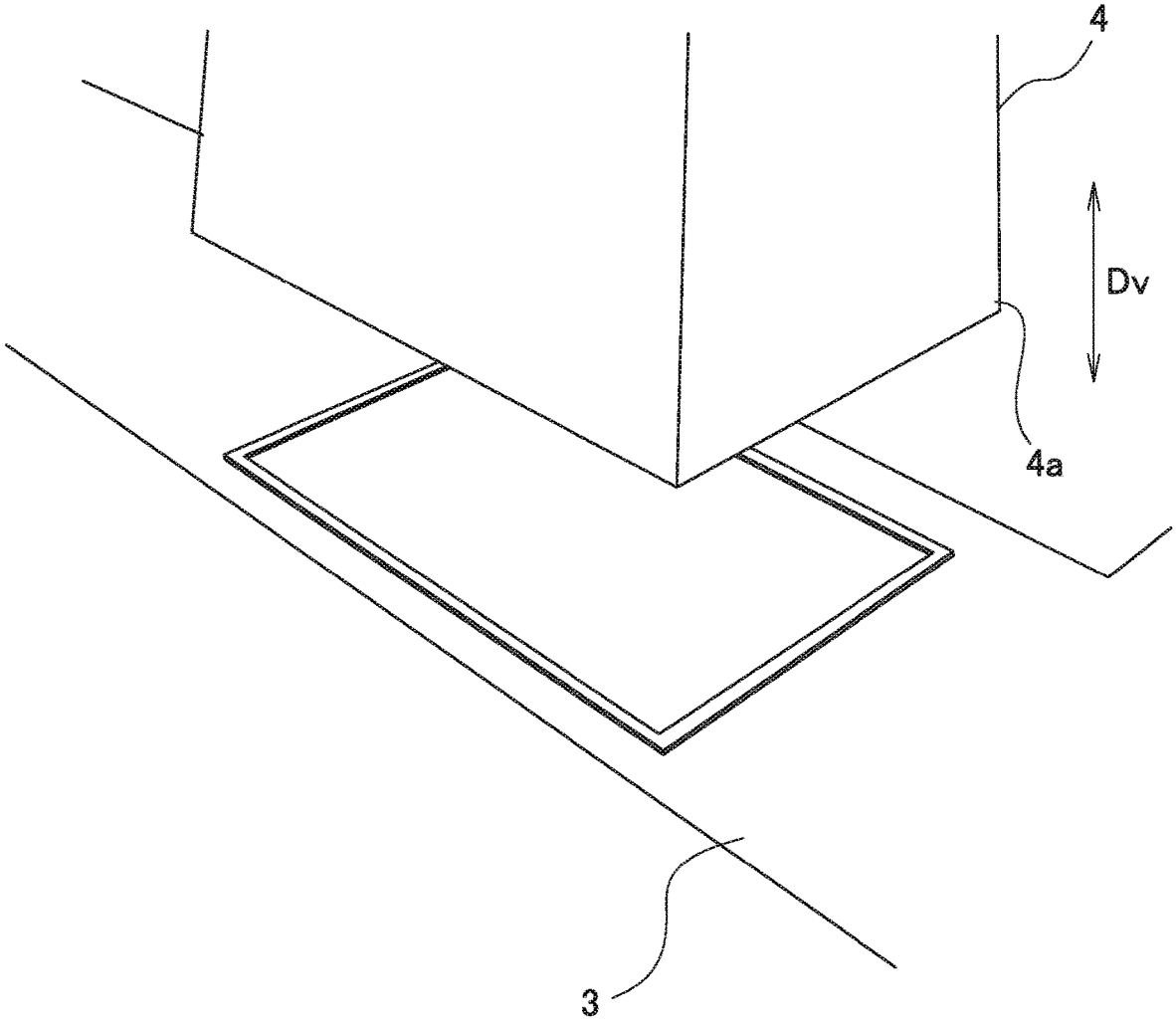
FIG. 4 is a perspective view showing a state where the first support leg is removed from a base plate in the method for installing a rotary machine of the embodiment.

Next, as shown in FIG. 4, the base plate 3 is prepared on the foundation by removing each of the first support legs 4 fixed on the base plate 3 from the base plate 3 (preparing step S2). Specifically, a portion between each of the lower end portions 4*a* of the first support legs 4 and the base plate 3 is cut, for example, by fusion cutting or the like. After then, the plurality of first support legs 4 are removed from the base plate 3. After the first support legs 4 are removed from the base plate 3, portions of the base plate 3 which had been bonded to the first support legs 4 are polished to eliminate unevenness. Accordingly, the preparation of the base plate 3 supporting the support legs is completed. After then, second support legs 14 and a second compressor main body (rotary machine main body) 15 of the second compressor 10 which is the new compressor (refer to FIG. 8) are installed onto the base plate 3.

Figure 8:
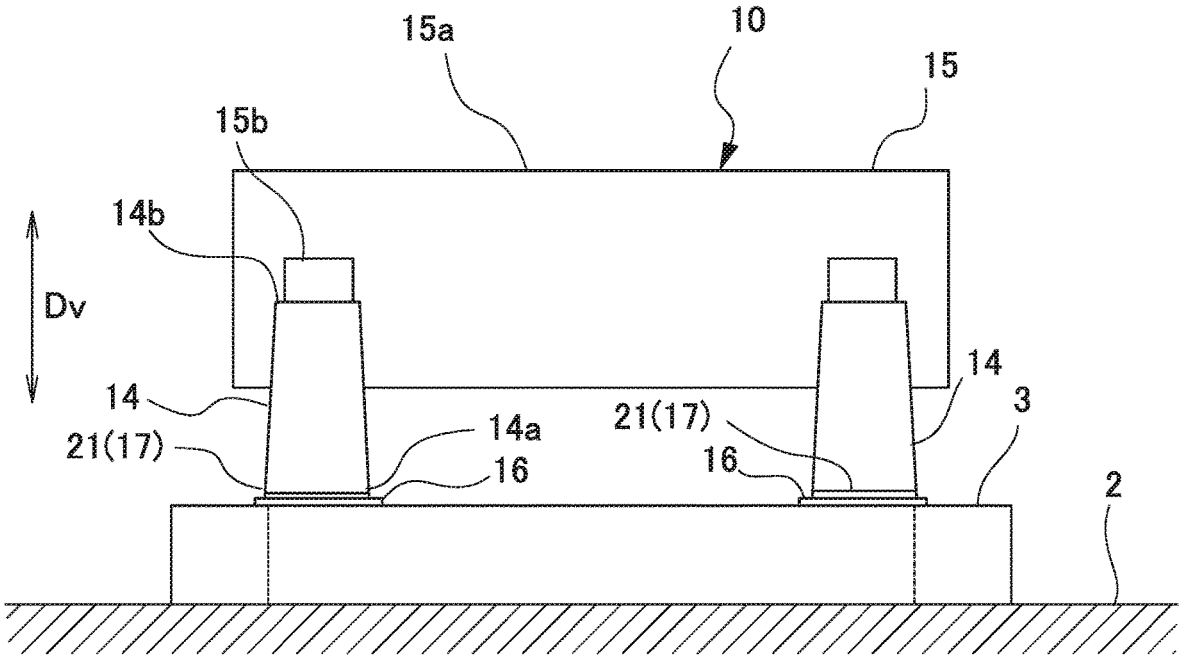
FIG. 8 is an elevation showing the second compressor installed in accordance with the method for installing a rotary machine of the embodiment.

As shown in FIG. 8, the second support legs 14 extend toward the vertical direction Dv as the first support legs 4 do. The second support legs 14 extend to the upper side in the vertical direction Dv from lower end portions 14*a* toward upper end portions 14*b*.

The second compressor main body 15 has a casing 15*a* forming a shell thereof and supported portions 15*b* protruding outwards from an outer peripheral surface of the casing 15*a*, like the first compressor main body 5.

Figure 5:
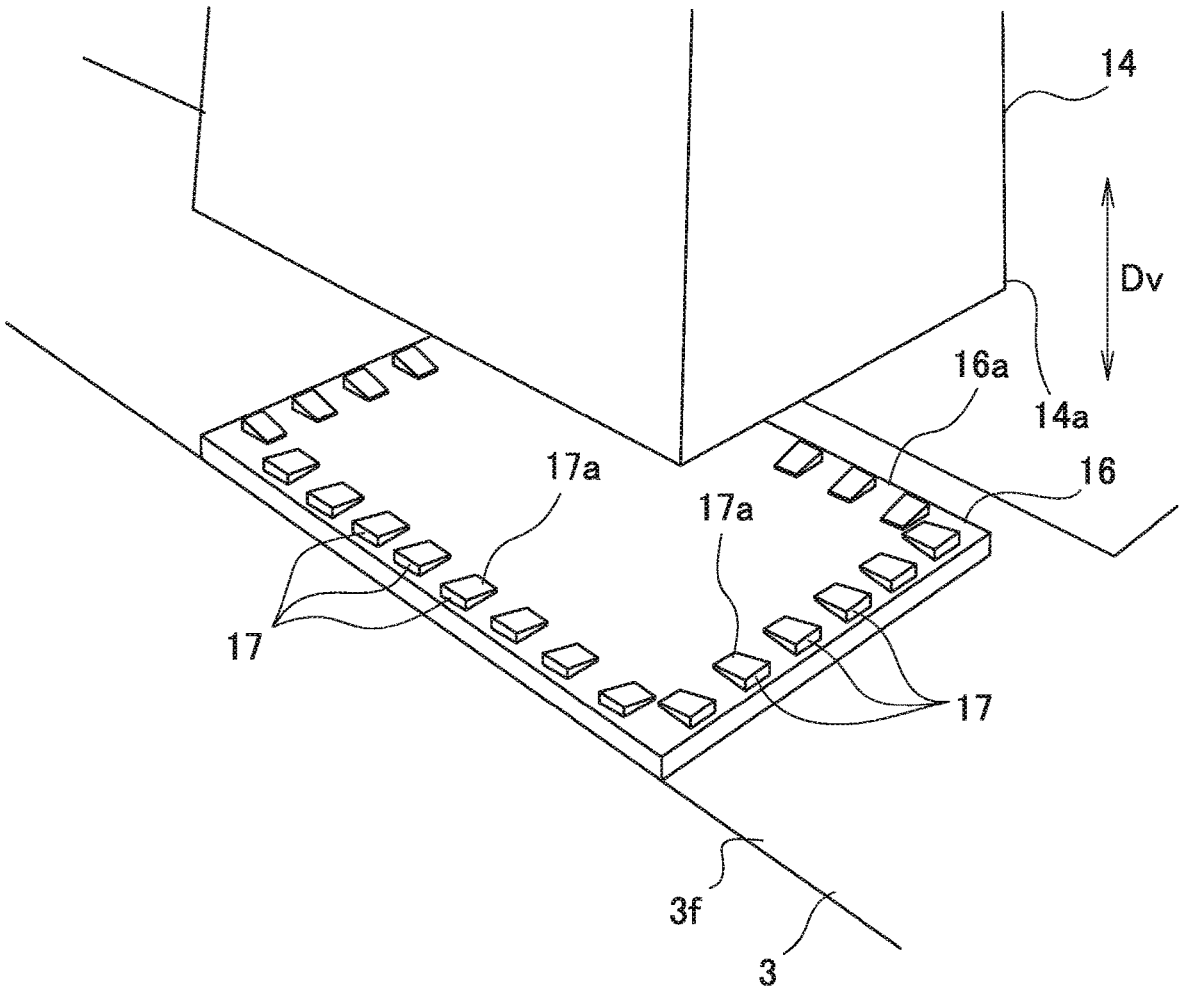
FIG. 5 is a perspective view showing a state where a level adjusting member is set on a liner plate in the method for installing a rotary machine of the embodiment.

As shown in FIG. 5, after removing the first support legs 4 and before a level adjusting member disposing step S4 to be described later, new liner plates (liner members) 16 are installed onto portions on the base plate 3 where the second support legs 14, which are new support legs, are to be installed (liner member disposing step S3). The liner plates 16 have a rectangular plate shape. The liner plates 16 are formed of a steel material that is the same as the base plate 3. The liner plates 16 are disposed at an installing position of the second compressor 10, which is the new compressor to be described later. The liner plates 16 are integrally fixed to the base plate 3 by outer peripheral portions 16*a* of the liner plates 16 being welded to an upper surface 3*f* of the base plate 3. The liner plates 16 may be disposed so as to overlap portions of the base plate 3, to which the first support legs 4 had been bonded.

Next, a plurality of level adjusting members 17 are disposed onto the base plate 3 along each of outlines of the lower end portions 14*a* of the second support legs 14 (level adjusting member disposing step S4). In the embodiment, the plurality of level adjusting members 17 are disposed onto each of the liner plates 16 fixed to the base plate 3. Each of the level adjusting members 17 has a wedge shape of which a height dimension gradually decreases toward a tip portion 17*a*. The level adjusting members 17 are formed of a steel material that is the same as the base plate 3. It is preferable to dispose the plurality of level adjusting members 17 at equal intervals in a peripheral direction along each of the outlines of the lower end portions 14*a* of the second support legs 14. In addition, each of the level adjusting members 17 is disposed such that the tip portion 17*a* faces an inner side of the second support leg 14 when seen from the upper side in the vertical direction Dv.

After then, the second support legs 14 and the second compressor main body (rotary machine main body) 15 of the second compressor 10 which is the new compressor (refer to FIG. 8) are placed (placing step S5). Specifically, each of the second support legs 14 is placed onto the plurality of level adjusting members 17. At this time, the tip portions 17*a* of the level adjusting members 17 come into a state of being sandwiched between the second support leg 14 and the liner plate 16, and part of each of the level adjusting members 17 comes into a state of projecting from the second support leg 14 to an outer side.

The second support legs 14 may be integrally attached to the second compressor main body 15 in advance, or the second support legs 14 may be attached to the second compressor main body 15 after fixing the second support legs 14 to the base plate 3. In a case where the second support legs 14 and the second compressor main body 15 are integrally attached to each other in advance, the second compressor main body 15 to which the plurality of second support legs 14 are attached is lifted, and each of the second support legs 14 is put onto the plurality of level adjusting members 17 set on each of the liner plates 16. Accordingly, the plurality of level adjusting members 17 are interposed between each of the liner plates 16 and each of the second support legs 14.

Figure 6:
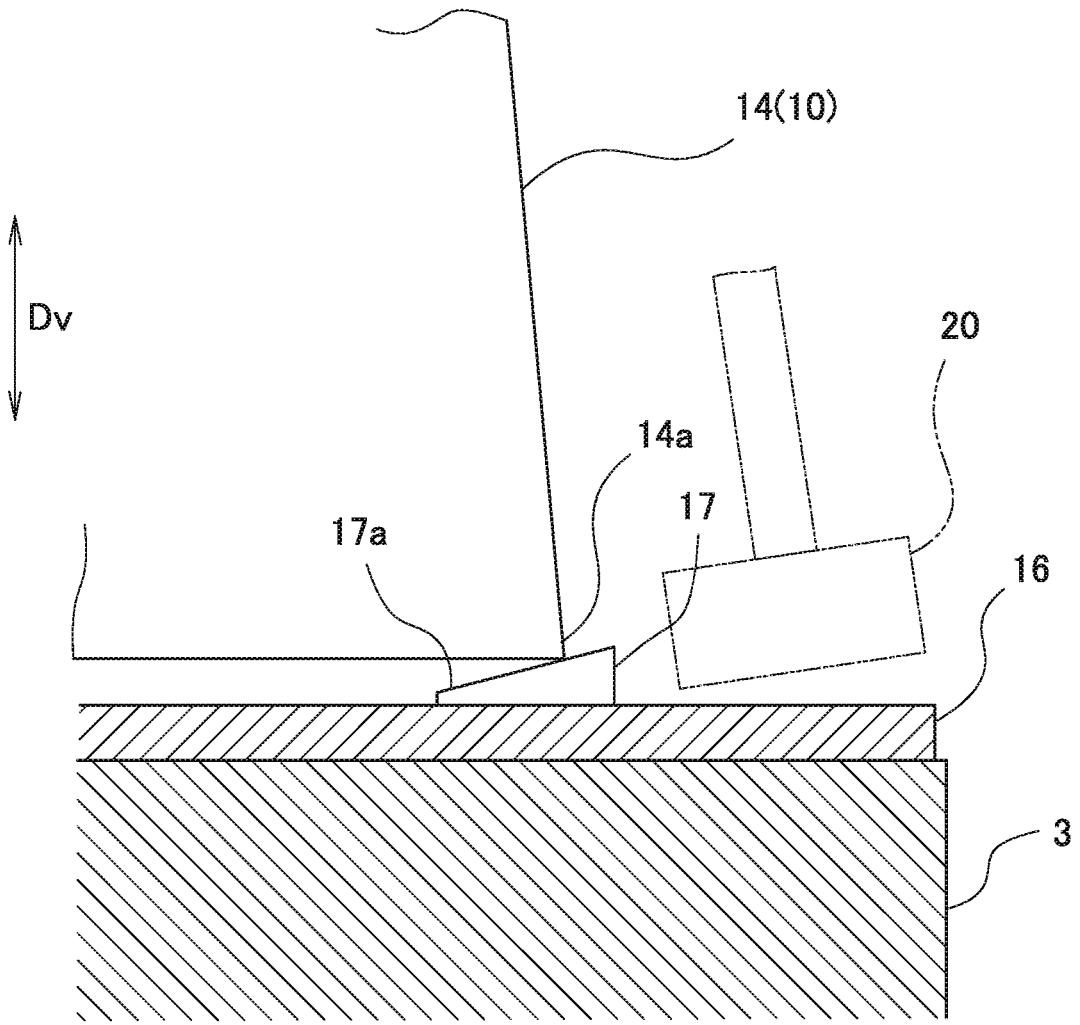
FIG. 6 is a perspective view showing a state where horizontal level adjustment of a second compressor main body is performed by pushing the level adjusting member so as to be placed under a second support leg in the method for installing a rotary machine of the embodiment.

Next, as shown in FIG. 6, the horizontal level of the second compressor main body 15 is adjusted by adjusting the pushing amounts of the level adjusting members 17 to the lower end portions 14*a* of the second support legs 14 (adjusting step S6). Specifically, as for each of the second support legs 14, the level adjusting members 17 are hit into an interior between the liner plate 16 and the second support leg 14 by a hammer 20 or the like. Accordingly, the pushing amounts of the level adjusting members 17 with respect to the lower end portion 14*a* of the second support leg 14 are adjusted. Since the level adjusting members 17 have a wedge shape, the height of the upper end portion 14*b* of the second support leg 14 is adjusted by the adjustment of the pushing amounts. As a result, the height of the supported portion 15*b* of the second compressor main body 15 placed onto the upper end portion 14*b* of the second support leg 14 is adjusted. Accordingly, the horizontal level adjustment of the second compressor main body 15 is performed such that a rotary shaft (not shown) provided in the second compressor main body 15 becomes horizontal.

Figure 7:
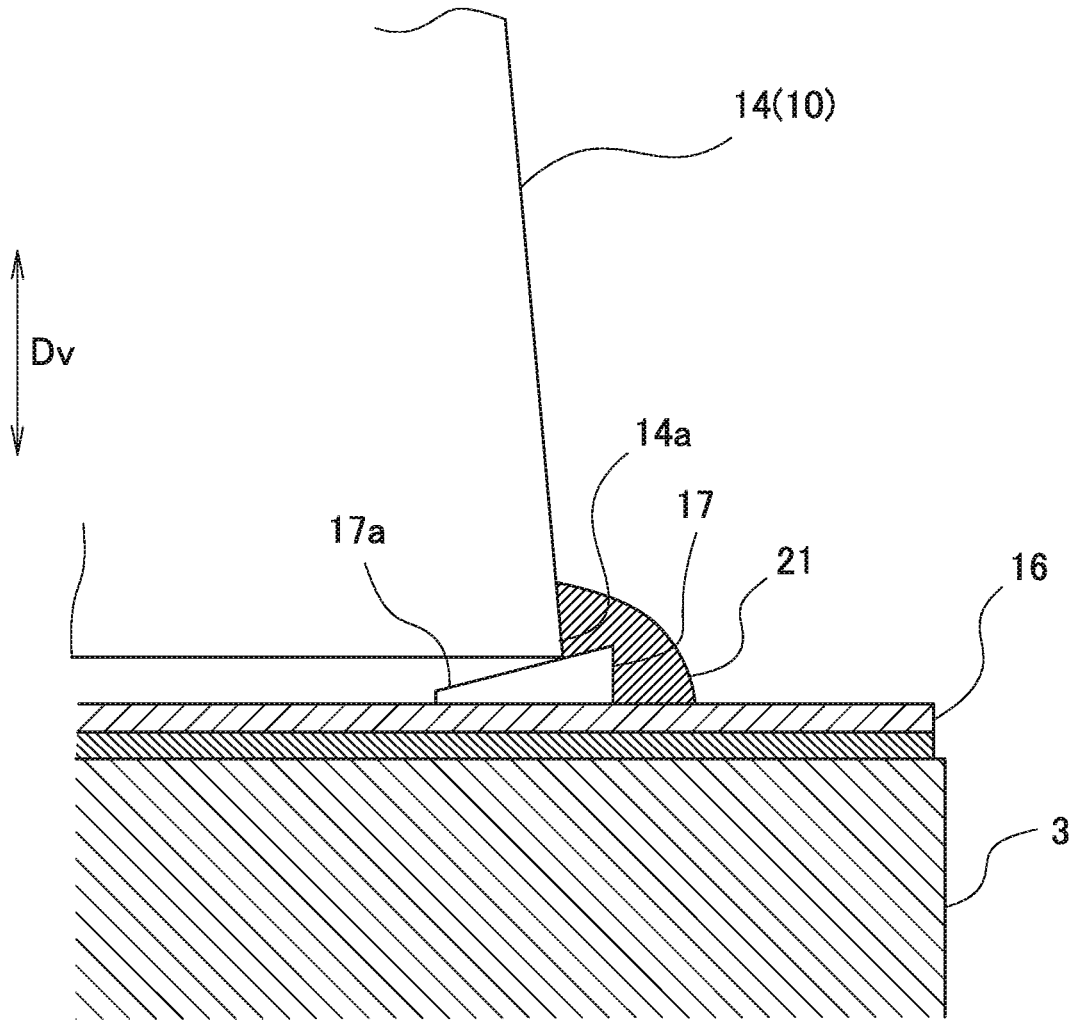
FIG. 7 is a perspective view showing a state where the second support leg is welded to the level adjusting member and the liner plate in the method for installing a rotary machine of the embodiment.

As shown in FIG. 7, after the adjusting step S6, each of the lower end portions 14*a* of the second support legs 14, the liner plate 16, and the level adjusting members 17 are welded to each other. Accordingly, the positions of the second support leg 14 and the level adjusting members 17 are fixed with respect to the base plate 3 (fixing step S7). The lower end portion 14*a* of the second support leg 14 and the liner plate 16 are continuously welded to each other over the entire periphery of the lower end portion 14*a* of the second support leg 14 so as to engulf the level adjusting members 17. Accordingly, a weld bead (fixing unit) 21 is formed so as to cover the lower end portion 14*a* of the second support leg 14 from the peripheral direction. The plurality of level adjusting members 17 interposed between each of the liner plates 16 and each of the second support legs 14 are bonded to the liner plate 16 by the weld bead 21 so as to be integrally attached to the second support leg 14.

The weld bead 21 is formed by the lower end portion 14*a* of the second support leg 14 being welded to the plurality of level adjusting members 17. The weld bead 21 fixes the positions of the second support leg 14 and the level adjusting members 17 with respect to the base plate 3 via the liner plate 16.

Accordingly, as shown in FIG. 8, the already installed first compressor 1 can be replaced with the new second compressor 10 and the second compressor 10 can be installed. Therefore, the second compressor 10 includes the base plate 3, the liner plates 16, the level adjusting members 17, the second support legs 14, the weld beads 21, and the second compressor main body 15.

In the method for installing a rotary machine and the rotary machine of the embodiment described above, the horizontal level adjustment of the upper end portions 14*b* of the second support legs 14 with respect to the base plate 3 can be performed by adjusting the pushing amounts of the wedge-shaped level adjusting members 17 to each of the lower end portions 14*a* of the second support legs 14. Therefore, the horizontal level adjustment of the second compressor main body 15, which is fixed to the upper end portions 14*b* of the second support legs 14 via the supported portions 15*b*, can be performed. Accordingly, the levelness of the second compressor main body 15 with respect to the base plate 3 can be easily and reliably adjusted. Therefore, the levelness of the second compressor 10 can be ensured by adjusting the positions of the second support legs 14 with respect to the base plate 3.

In addition, the flat plate-shaped liner plates 16 are provided on the base plate 3, and the plurality of level adjusting members 17 are disposed on each of the liner plates 16. For this reason, even in a case where the upper surface of the base plate 3 is not smooth, the level adjusting members 17 can be disposed on each of smooth surfaces of the flat plate-shaped liner plates 16. Therefore, regardless of the state of the base plate 3, the level adjusting members 17 can be easily moved when adjusting the pushing amounts of the level adjusting members 17 to lower sides of the second support legs 14.

In addition, after the existing first compressor main body 5 and the existing first support legs 4 are removed, the new second compressor main body 15 and the new second support legs 14 are installed with the use of the base plate 3 to which the existing first support legs 4 had been fixed. Therefore, work efficiency improvement and cost reduction can be achieved without a need for reinstalling the base plate 3 when newly installing a compressor.

Although the embodiment of the present invention has been described in detail with reference to the drawings hereinbefore, respective configurations, combinations of the configurations of the embodiment, and the like are merely examples. It is possible to make addition, omission, replacement, and other modifications of a configuration without departing from the scope of the present invention. In addition, the present invention is not limited by the embodiment, and is limited only by claims.

For example, although a case where the already installed first compressor 1 is replaced with the new second compressor 10 is given as an example in the embodiment, the invention is not limited thereto. For example, even in a case where the new second compressor 10 is installed at a place where there is no first compressor 1, it is possible to apply the present invention. In this case, it is sufficient to newly install the base plate 3 onto the foundation in the step of preparing the base plate 3.

In addition, although the compressor is given as an example of a rotary machine in the embodiment, without being limited thereto, the method for installing a rotary machine of the present invention is applicable even when various turbines, electric motors, or the like are applied as a rotary machine.

INDUSTRIAL APPLICABILITY

In the method for installing a rotary machine and the rotary machine, the levelness of the rotary machine can be ensured by adjusting the positions of the support legs with respect to the base plate.

REFERENCE SIGNS LIST

1: first compressor (rotary machine)
2: foundation
3: base plate
3*f*: upper surface
4: first support leg (support leg)
4*a*: lower end portion
4*b*: upper end portion
5: first compressor main body (rotary machine main body)
5*a*: casing
5*b*: supported portion
10: second compressor (rotary machine)
14: second support leg (support leg)
14*a*: lower end portion
14*b*: upper end portion
15: second compressor main body (rotary machine main body)
16: liner plate (liner member)
16*a*: outer peripheral portion
17: level adjusting member
17*a*: tip portion
20: hammer
21: weld bead (fixing unit)
S1: compressor main body removing step
S2: preparing step
S3: liner member disposing step
S4: level adjusting member disposing step
S5: placing step
S6: adjusting step
S7: fixing step

What is claimed is:

1. A method for installing a rotary machine that includes a plurality of support legs extending in a vertical direction and a rotary machine main body fixed to upper end portions of the support legs, the method comprising:

a preparing step of preparing a base plate that supports the support legs onto a foundation;

a level adjusting member disposing step of disposing a plurality of level adjusting members having a wedge shape onto the base plate;

a placing step of placing each of the support legs onto the plurality of level adjusting members;

an adjusting step of adjusting a horizontal level of the rotary machine main body by adjusting pushing amounts of the level adjusting members to each of lower end portions of the support legs; and a fixing step of fixing positions of each of the support legs and the level adjusting members with respect to the base plate by welding each of the support legs to the plurality of level adjusting members, wherein each of the plurality of level adjusting members on the base plate has a height in the vertical direction, the height gradually decreases toward a tip portion of the wedge shape, in the level adjusting member disposing step, each of the plurality of level adjusting members is disposed on the base plate such that the tip portion faces an inner side of each of the support legs when seen from an upper side in the vertical direction, and the level adjusting members on the base plate are disposed apart from each other at intervals in a peripheral direction along each outline of lower end portions of the support legs.

2. The method for installing a rotary machine according to claim 1, further comprising:

a liner member disposing step of disposing a flat plate-shaped liner member onto the base plate before the level adjusting member disposing step, wherein in the level adjusting member disposing step, the plurality of level adjusting members is disposed onto the liner member fixed to the base plate, and in the fixing step, each of the support legs and the plurality of level adjusting members are welded to the liner member.

3. The method for installing a rotary machine according to claim 2, wherein in the preparing step, existing support legs fixed on the base plate are removed from the base plate.

4. The method for installing a rotary machine according to claim 1, wherein in the preparing step, existing support legs fixed on the base plate are removed from the base plate.

5. A rotary machine, comprising:

a base plate installed on a foundation;

a plurality of wedge-shaped level adjusting members provided on the base plate;

a plurality of support legs which are placed on the plurality of level adjusting members and extend toward a vertical direction;

a fixing unit which is formed by each of lower end portions of the support legs and the plurality of level adjusting members being welded to each other and fixes positions of each of the support legs and the level adjusting members with respect to the base plate; and a rotary machine main body supported by the plurality of support legs, wherein each of the plurality of level adjusting members on the base plate has a height in the vertical direction, the height gradually decreases toward a tip portion of the wedge shape, each of the plurality of level adjusting members is disposed on the base plate such that the tip portion faces an inner side of each of the support legs when seen from an upper side in the vertical direction, and the level adjusting members on the base plate are disposed apart from each other at intervals in a peripheral direction along each outline of lower end portions of the support legs.

* * * * *